US006280346B1

(12) United States Patent
Gedeon

(10) Patent No.: US 6,280,346 B1
(45) **Date of Patent: *Aug. 28, 2001**

(54) GOLF PUTTER

(76) Inventor: Robert J. Gedeon, 2906 Eastwind Dr., Amelia Island, FL (US) 32034

( * ) Notice: Subject to any disclaimer, the term of this patent is extended or adjusted under 35 U.S.C. 154(b) by 0 days.

This patent is subject to a terminal disclaimer.

(21) Appl. No.: 09/534,640

(22) Filed: Mar. 27, 2000

Related U.S. Application Data

(62) Division of application No. 09/263,559, filed on Mar. 8, 1999, now Pat. No. 6,048,275, which is a continuation of application No. 08/886,431, filed on Jul. 2, 1997, now abandoned.

(51) Int. Cl.[7] ..... A63B 53/14

(52) U.S. Cl. ..... 473/293; 473/300; 473/313; 473/316

(58) Field of Search ..... 473/294, 298, 473/299, 201, 203, 204, 300, 301, 302, 303, 304, 293, 549, 316, 313, 314; D21/756, 757

(56) References Cited

U.S. PATENT DOCUMENTS 1,506,523 * 8/1924 Gordon .
1,687,170 * 10/1928 Mattern .
2,002,535 * 5/1935 Gagnier .
2,121,718 * 6/1938 Sweetland .
2,357,491 * 9/1944 Park .
2,628,099 * 2/1953 Murphy .
2,820,638 * 1/1958 Morrison .
2,843,384 * 7/1958 Schmidt .
3,466,047 * 9/1969 Rodia .
3,574,349 * 4/1971 Kropp .
3,692,306 * 9/1972 Glover .
4,163,554 * 8/1979 Bernhardt .
4,215,860 * 8/1980 Nakamatsu .
4,227,694 * 10/1980 Drake .
4,537,403 * 8/1985 Farina .
4,592,552 * 6/1986 Garber .
4,795,158 * 1/1989 Kuykendall .
5,125,657 * 6/1992 Beil .
5,267,733 * 12/1993 Szokola .
5,340,104 * 8/1994 Griffin .
5,573,468 * 11/1996 Baumann .
5,588,921 * 12/1996 Parsick .
5,645,493 * 7/1997 Garcia .
5,676,606 * 10/1997 Schaeffer .
5,711,719 * 1/1998 Fireman .
5,779,559 * 7/1998 Eberle .
5,800,283 * 9/1998 Nomura .
5,890,977 * 4/1999 Taylor .
5,947,838 * 9/1999 Tkacs .
6,048,275 * 4/2000 Gedeon .

* cited by examiner

*Primary Examiner*—Sebastiano Passaniti
(74) *Attorney, Agent, or Firm*—Arthur G. Yeager

(57) ABSTRACT

This invention relates to a golf putter having a bulbous mallet head joined to an upright shaft having a tapering grip that is at least flat on one of its sides and may be square in cross-section over its entire length and extends from the upper extremity of the shaft to adjacently above the head. The juncture of the shaft to the head is in the form of a goose-neck from adjacent the lower end of the grip to a rear entry into the head.

20 Claims, 2 Drawing Sheets

GOLF PUTTER

CROSS REFERENCE TO RELATED APPLICATIONS

This application is a divisional of U.S. Ser. No. 09/263,559 filed Mar. 8, 1999 entitled GOLF PUTTER now U.S. Pat. No. 6,048,275 which was a continuation of U.S. Ser. No. 08/886,431, filed on Jul. 2, 1997 entitled GOLF PUTTER now abandoned.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a golf putter, and more specifically to a golf putter with a mallet head, a shaft covered over most of its length with a tapering grip, and a goose-neck juncture between the head and the shaft.

2. Prior Art

Among the various clubs used by a golfer playing a round of golf is the putter, most often used on the green to cause the ball to roll to the cup. The putter has a face for striking the ball that is substantially perpendicular to the ground so that the ball when stroked will roll and not be elevated into the air, as is the case with a chip shot made with a club that has a face at a greater angle from perpendicular. Some putter designs have been made where the face is not precisely at 90 degrees to the ground, but rather is a few degrees +/− from 90 degrees so as to provide top spin or, alternatively, to provide a slight elevation to the ball. Regardless of this feature a putter is a very important and necessary club for every golfer to own.

There are a variety of designs including shape, material of construction, grip, markings on the club head and most importantly, weight to appeal to the taste of every golfer. One popular style is a mallet head, which as the name implies, resembles a portion of a mallet (such as a croquet mallet or a carpenter's mallet). Generally a mallet head putter has come to include a variety of shapes, quite frequently any bulbous shape, such as an apple or a potato, that has been cut by two intersecting planes to provide a flat sole and a flat face. The putter of this invention is a mallet head type, with the principal features distinguishing it from any known in the past. These principal features include the design of the shaft and grip, and the design of the connecting portions of the head and the shaft.

It is an object of this invention to provide a novel golf putter. It is another object of this invention to provide a novel mallet head putter having a long grip with at least one flat side and a gooseneck junction joining the head to the shaft. Still other objects will become apparent from the more detailed description which follows.

BRIEF SUMMARY OF THE INVENTION

This invention relates to a golf putter having a bulbous mallet head with a flat sole and a flat face intersecting at an acute angle, and a cylindrical shaft having its lower end inserted into an internal horizontal recess having an entryway at the back side of the head; the shaft being covered over substantially all of its length with a grip having a larger cross-section at its upper end and reducing along its tapered length.

In specific and preferred embodiments the shaft is tilted away from the vertical in the general plane of the face of the head at an angle of 10 degrees to 15 degrees from a position perpendicular to the sole. In another specific and preferred embodiment the recess in the head for receiving the lower end of the shaft has an axis parallel to the sole at a distance above the lower surface of the sole that approximates the radius of a golf ball i.e., 0.8 to 1.2 inches. Another specific and preferred embodiment is found in the grip that covers the shaft. The grip extends substantially the full straight length of the shaft. At its lower end the shaft enters a hosel bent into a gooseneck shape to join the horizontal recess in the head to the generally vertical shaft. The grip is a long thin tapering shape having at least one flat side at any location along its length. This permits the putter to be used in a "side-saddle" position facing the hole or the more common position facing transverse to the putting line.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 4:
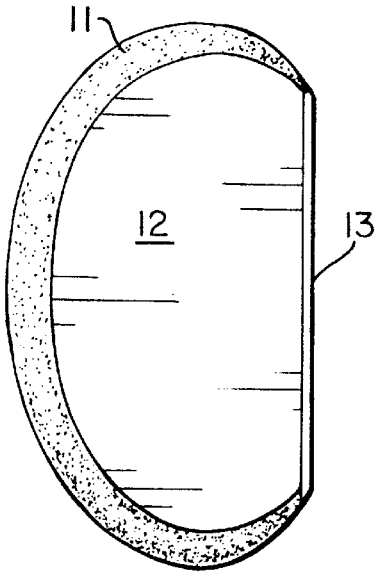
FIG. 4 is a front elevational view of the putter head of FIG. 1 showing the face of the putter.
Figure 1:
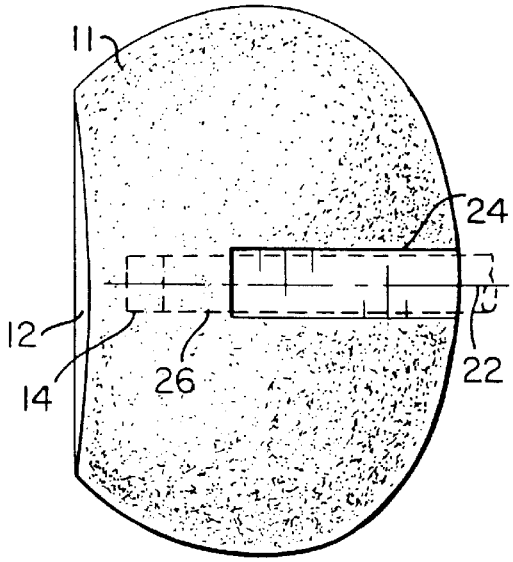
FIG. 1 is a top plan view of the head of the putter of this invention.
Figure 5:
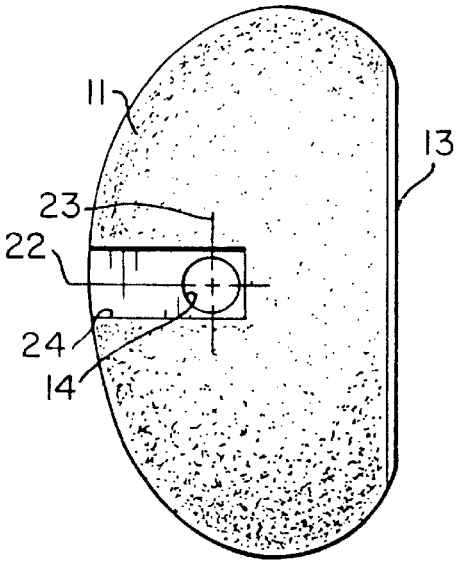
FIG. 5 is a rear elevational view of the putter head of FIG. 1.
Figure 2:
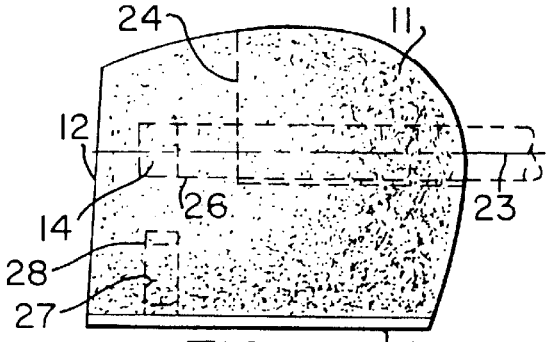
FIG. 2 is a side elevational view of the putter head of FIG. 1.
Figure 3:
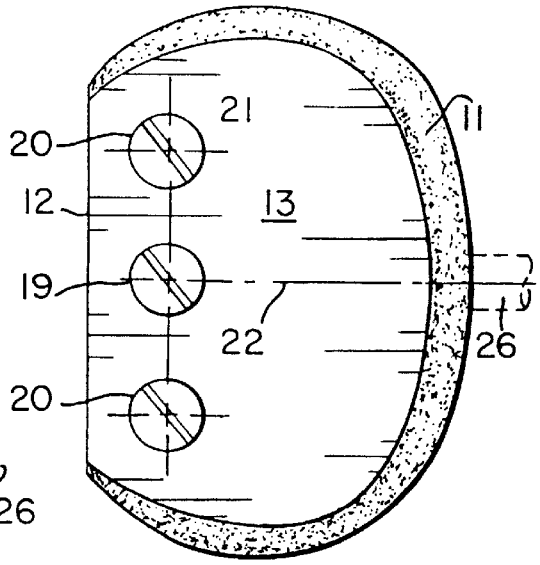
FIG. 3 is a bottom plan view of the putter head of FIG. 1 showing the sole of the head.
Figure 6:
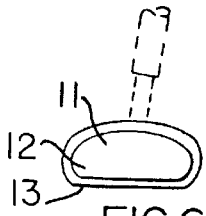
FIG. 6 is a small scale view similar to FIG. 4 showing the position of the shaft.
Figure 7:
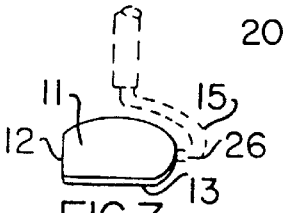
FIG. 7 is a small scale view similar to FIG. 2 showing the position of the shaft.

The invention is best understood by reference to the accompanying drawings wherein the same reference number is employed in different drawings to indicate the same feature.

The golf putter of this invention has some of the same general parts as do most other putters; namely a shaft, a hosel, a head, and a grip. In the drawings of this invention the head 11 is attached to a lower portion of the shaft through a gooseneck portion 15 and all the remainder of the shaft is a straight portion 17. The shaft 17 is covered from its upper end 16 to just above the gooseneck portion 15 with a grip or cover 18 of a rubberized material. The shaft 15, 16, 17 is a tube or a rod of any stiff lightweight material, e.g., metal, in the form of steel or aluminum or composite composition, e.g., graphite, glass fiber, carbon fiber, or the like.

The head is of a design frequently referred to in the golfing world as a mallet head. It is a bulbous article, rounded on all but two sides which are planar or almost planar. These two sides are a face 12 and a bottom covered by a sole 13. These two sides or surface intersect in a straight line, if both surfaces are planar. In some designs the sole 13 is convexly or concavely curved very slightly away from planar, but for the purposes of this description it will be understood that sole 13 will be described as planar which is intended to include the very slightly curved convex or concave sole. The bottom face of the head is covered with a flat sole 13, frequently made of brass. The bulbous head is preferably an injection-molded graphite composition, but may be made of metal or other solid materials. Furthermore, it is important to be able to add weight to the head so that any head may be balanced to suit the preferences of any golfer. Thus golf heads contain weight ports or recesses 27 to receive weight adjusting materials, such as slugs 28 or powder of lead or other heavy material. Also, weight adjustment may be accomplished by using different lengths of screws to the head rather than providing slug recesses. Generally these recesses are openable by removing one or more screw covers or screws 19 or 20 in sole 13. Preferably, the plane of the flat face 12 and the plane of flat sole 13 intersect at an angle of 85 to 89 degrees.

The remaining feature of the golf putter head of this invention is the recess 14 and slot 24. The lower end of shaft 15 is a gooseneck shaped hosel with the terminal portion of gooseneck portion 15 being a horizontal portion 26 that is a continuation of the shaft. That portion 26 fits tightly into recess 14 in head 11. In order to provide a rigid immovable connection, horizontal portion 26 is cemented into recess 14 by means of an epoxy cement or other top quality cement that will produce the rigid immovable joint. This joint may also be fastened with a pin to insure stability. Adjoining recess 14 is a cutaway slotted portion 24 of head 11 which is needed to assemble gooseneck portion 15 into head 11 and specifically into recess 14.

Figure 8:
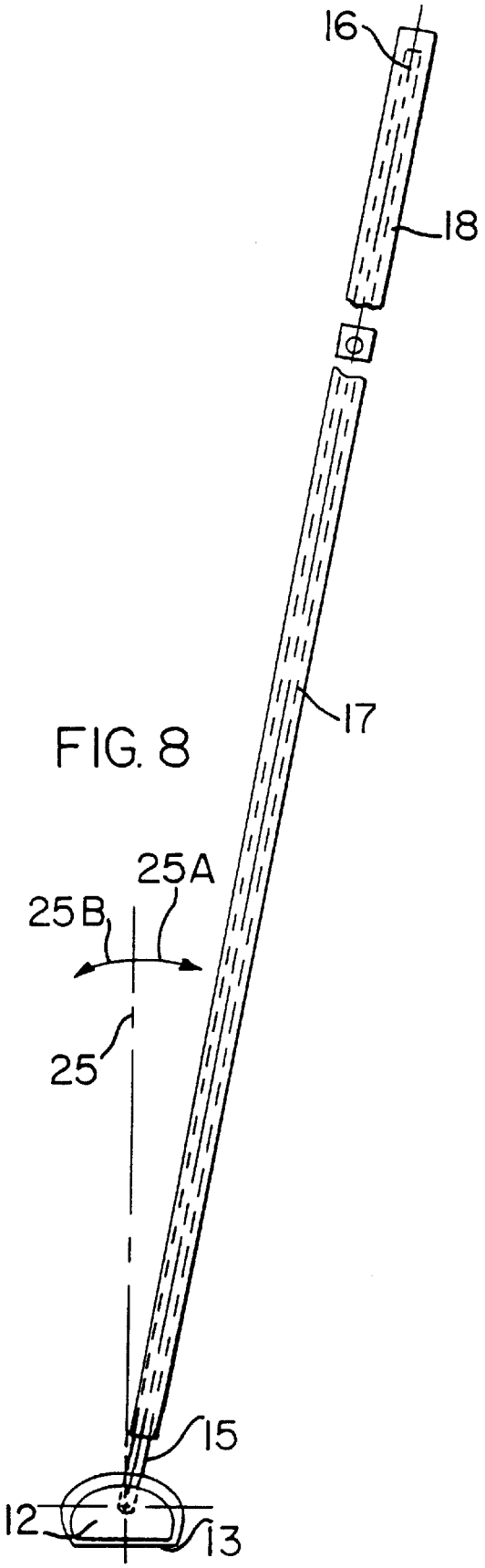
FIG. 8 is a front elevational view like that of FIG. 4 showing the entire club.
Figure 9:
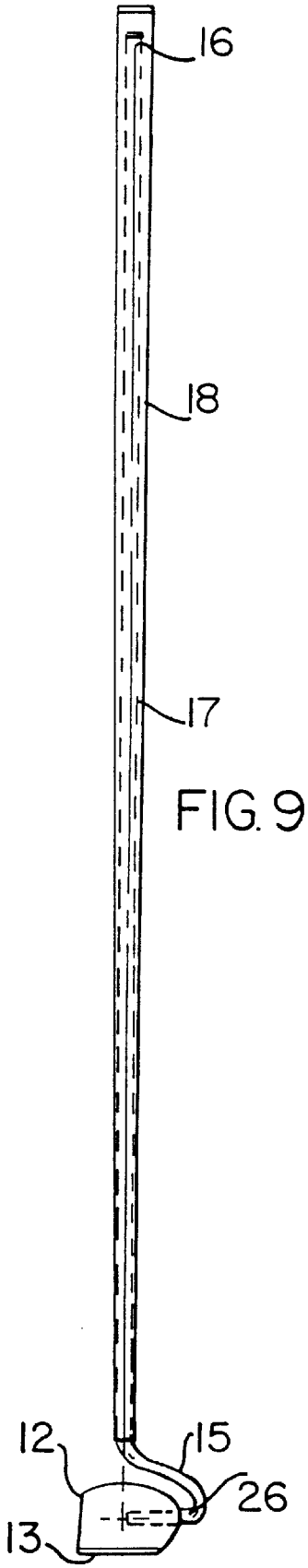
FIG. 9 is a side elevational view like that of FIG. 2 showing the entire club.

In FIGS. 8 and 9 the assembled golf putter may be seen. Grip 18 may be seen to extend over substantially the entire length of the straight portion 17 of the shaft. The lower part of the grip 18 is only used when the golfer crouches close to the ground or bends low over the ball in using the club. This can happen when the golfer putts by facing toward the hole holding the club with one hand close to head 11 and the other midway or higher along the shaft (the so-called "sidesaddle" putt). Still another position is taken when the golfer stands facing perpendicular to the line of the putt, and bends over the ball and the club until the top of the shaft touches the golfer's chest with one hand low on the grip 18 and the other hand at the top of grip 18. This putter can also be used as other putters are used with both hands generally close together in the upper portion of the grip 18, while the golfer faces perpendicular to the line of the putt.

It may be seen that the grip has at least one flat side and is preferably square in cross-sectional shape, although other shapes may be useful, e.g., rectangular, oval, round, trapezoidal, or the like. The shape is constant over the entire length of the shaft although the size tapers from larger at the upper end to smaller at the lower end. The grip may be made of any of several materials useful for golf club grips, including elastomeric compositions, artificial leather compositions, rubberized fabric compositions, leather-coated materials, etc. If only a single flat side of the grip is provided, the location thereof would be in a plane substantially parallel to the plane of face 12 of the head 11.

It may be seen that the putter as shown in FIG. 8 is approximately 11 degrees from perpendicular to the ground, and shows arrows 25 pointing both to the right and to the left. Most golfers putting sidesaddle or standing upright to putt while facing across the line of the putt prefer to have the shaft tilt at a small angle, between 10 and 15 degrees, from the vertical axis 25 in the general plane of the face 12. Some may prefer a shaft tilt away from the face and toward the golfer's body, so as to have a more comfortable stance in swinging the putter to and from the ball. Right-handed putters will want the tilt of the shaft to be in the direction of arrow 25A and left-handed putters will want the tilt to be in the direction of arrow 25B, as seen in FIG. 8. These adjustments may be made by the club manufacturer or any club repair person who knows how to break the bond of epoxy cement and how to readjust the tilt angle and re-cement the shaft to the head. Of course, if the golfer needs to have the club in compliance with, for example, USGA Rules, some of golfer preferences may not be adopted.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A golf putter comprising a head having a substantially flat planar face, an elongated shaft having an upper portion and a lower portion, said lower portion being connected to and supporting said head, said shaft having a predetermined length and extending generally vertically, an elongated grip having at least one substantially continuous flat single planed and elongated side extending from said shaft upper portion to adjacent said shaft lower portion and covering at least one-half said shaft length, said predetermined length of said shaft being of a sufficient length to permit said putter to be used by a golfer in at least one position in which a golfer stands transverse to a putting line.

2. The golf putter of claim 1 wherein said shaft tilts in the general plane of said face at an angle of about 10 degrees to 15 degrees from a position perpendicular to a bottom of said head.

3. The golf putter of claim 1 wherein said cross-section of said grip is substantially square.

4. The golf putter of claim 1 wherein said grip is an elastomeric composition.

5. The golf putter of claim 1 wherein said grip is a rubberized fabric composition.

6. The golf putter of claim 1 wherein said grip is a leather coated composition.

7. The golf putter of claim 1 wherein said grip is an artificial leather composition.

8. The golf putter of claim 1 wherein said grip includes at least another flat single planed elongated side between said upper and lower portions extending generally parallel to said at least one flat single planed elongated side.

9. The golf putter of claim 1 wherein said grip extends substantially the full length of said shaft.

10. The golf putter of claim 9 wherein said grip includes four flat elongated sides between said upper and lower portions.

11. The golf putter of claim 1 wherein said grip includes four flat elongated sides between said upper and lower portions.

12. The golf putter of claim 8 wherein said another flat elongated side extends at least one-half the length of said shaft.

13. A grip for a golf putter having a head supported by a bottom end portion of an elongated shaft having a predetermined length and an upper portion and a lower portion and extending generally vertically, said grip comprising at least one substantially continuous flat single planed and elongated side extending from a shaft upper portion to adjacent a shaft lower portion covering at least one-half a shaft length which is sufficient to permit gripping of said grip by a golfer in at least one position standing transverse to a putting line to enable putting of a ball by a putter.

14. The grip of claim 13 wherein said at least one flat side extends substantially the full length of the shaft.

15. The grip of claim 13 further comprising three additional elongated flat sides forming with said at least one flat side a substantially square cross-section.

16. The grip of claim 13 wherein said cross-section of said grip is larger at its upper end tapering to its smaller lower end.

17. The grip of claim 13 wherein said grip is formed from an elastomeric composition.

18. The grip of claim 13 wherein said grip is formed from a rubberized fabric composition.

19. The grip of claim 13 wherein said grip is formed from a leather coated composition.

20. The grip of claim 13 wherein said grip is formed from an artificial leather composition.

* * * * *